United States Patent [19]

Dunn et al.

[11] 3,967,527

[45] July 6, 1976

[54] METHOD OF PRODUCING A CAVITY IN THE BURSTING CHARGE OF A HIGH EXPLOSIVE PROJECTILE

[75] Inventors: John A. Dunn, Parsippany; Leonard Frank, Hackettstown, both of N.J.

[73] Assignee: The United States of America as represented by the Secretary of the Army, Washington, D.C.

[22] Filed: July 11, 1975

[21] Appl. No.: 595,194

[52] U.S. Cl. ..... 86/20 B; 86/1 R; 264/3 R; 264/263

[51] Int. Cl.[2] ..... C06B 21/00; F42B 3/00

[58] Field of Search ..... 102/66, 90, 56, 58; 86/1 R, 20 R, 20 B; 264/3 R, 263; 29/1.2, 1.21, 1.22, 1.23

[56] References Cited

UNITED STATES PATENTS

| | | | |
|---|---|---|---|
| 1,453,933 | 5/1923 | Gibbons et al. | 86/20 B |
| 1,477,040 | 12/1923 | Davidson | 86/31 |
| 2,960,000 | 11/1960 | Thomas | 86/20 B |
| 3,159,076 | 12/1964 | Meissner | 86/20 |

FOREIGN PATENTS OR APPLICATIONS

| | | | |
|---|---|---|---|
| 1,080,732 | 12/1954 | France | 86/20 B |

*Primary Examiner*—Harold Tudor
*Attorney, Agent, or Firm*—Nathan Edelberg; A. Victor Erkkila; Thomas R. Webb

[57] ABSTRACT

A supplementary charge cavity is formed in the explosive charge of a high explosive projectile by: rigidly securing an open-ended tubular metal liner axially within the threaded opening or bore of a hollow projectile housing: inserting, within the liner, the shaft of a long-shafted funnel until the lower end is flush with the lower end of the liner and an annular flange on the funnel engages the end of the housing, with a liquid-tight seal between the two lower ends; pouring molten explosive material into the funnel until the housing and funnel are filled to a level above the liner, allowing the material to cool to a solid state; rotating the funnel to shear the case material at the lower end of the funnel; removing the funnel; and securing a closure disc in the lower end of the liner.

5 Claims, 7 Drawing Figures

METHOD OF PRODUCING A CAVITY IN THE BURSTING CHARGE OF A HIGH EXPLOSIVE PROJECTILE

GOVERNMENTAL INTEREST

The invention described herein may be manufactured, used and licensed by or for the Government for governmental purposes without the payment to me of any royalty thereon.

BACKGROUND AND SUMMARY OF THE INVENTION

Present design of medium and large caliber explosive projectiles require that a cavity be formed in the main or bursting explosive charge for receiving a supplementary charge or a long intrusion fuze. Heretofore, this cavity has usually been formed either by deep-drilling the main explosive charge after the latter has been poured while molten into the projectile housing and solidified or by use of a long-stemmed pouring funnel during explosive pour and a subsequent facing operation. In the latter method, the long-stemmed funnel is inserted into the open nose of the projectile housing, the molten explosive material is poured and cooled to a solid state, the funnel is removed, and the bottom of the cavity is then formed by the facing operation. After the cavity is formed, a cup-shaped metal liner is manually inserted and fixed in place in the cavity, as by swaging the outer end into the threaded opening in the housing.

These methods are hazardous to personnel involved, because the drilling in the first method and the facing and swaging operation in the second method are likely to cause detonation of the explosive material. Moreover, both methods require cleaning to remove residual cutting fragments, which is also hazardous.

For the protection of facilities, equipment and personnel, the prior methods rely on control, rather than elimination of hazardous operation. The measures used to control hazards include visual inspection for explosive contamination of projectile threads and isolation or barricading of the hazardous operations of drilling, thread cleaning, cavity facing and liner swaging. Such measures not only are not completely effective but also add to the cost of manufacturing the projectile.

An object of the present invention is to provide a method of forming a cavity in an explosive charge that eliminates or avoids the hazardous operations of thread cleaning, cavity facing and drilling, and the possibility of explosive hazard during liner swaging. Another object is to reduce the numbers of inspections that are required. A further object is to improve the quality of the product.

In accordance with the present invention an open-ended metal liner is inserted into and rigidly secured to the open end of a projectile housing prior to explosive pour, the stem of a long-stemmed funnel is inserted into the liner until the lower ends are flush with each other, with a liquid-tight seal between the lower ends, molten explosive material is poured into the funnel to fill the housing and funnel to a level above the liner and allowed to cool to a solid state, and the funnel is then rotated to shear the material at the lower end and removed from the liner and housing. Subsequently, a closure disc is secured in the lower end of the liner.

DETAILED DESCRIPTION OF A PREFERRED EMBODIMENT

Figure 1:
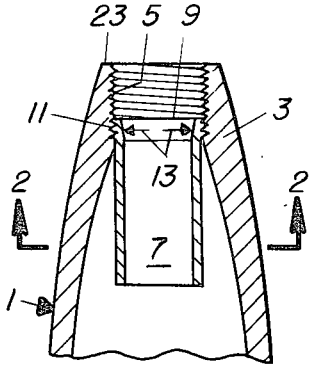
FIG. 1 is a fragmentary axial section view of a projectile housing with a liner mounted therein, as the first step in the method of the present invention.
Figure 2:
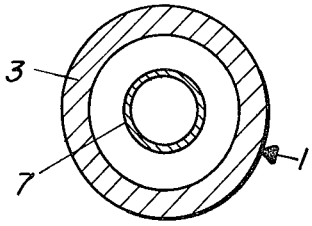
FIG. 2 is a transverse section view taken on line 2—2 of FIG. 1.

FIG. 1 illustrates the first step in the formation of a cavity in the high explosive charge in a projectile housing in accordance with the present invention. The numeral 1 indicates a hollow projectile housing having an ogive forward or nose end 3 with a axial threaded opening or bore 5 for receiving the usual fuze for initiating the projectile charge. An open-ended tubular metal liner 7, e.g. of aluminum, having an outer diameter equal to or less than the inner diameter of the threads in bore 5, is inserted within the threaded opening 5 and its upper end 9 is rigidly secured axially in the inner end 11 of opening 5, by a conventional internal swaging tool, as indicated schematically by the arrows 13.

Figure 3:
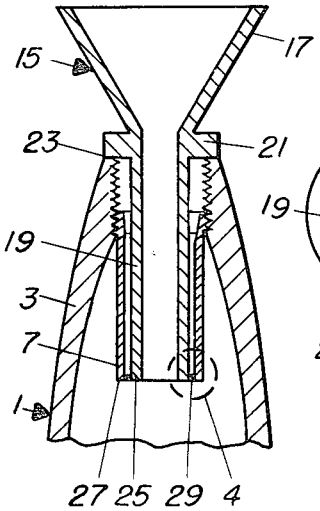
FIG. 3 is a view similar to FIG. 1 with the pouring funnel in place.
Figure 4:
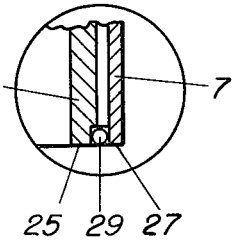
FIG. 4 is an enlargement of the circular area 4 of FIG. 3.

The next step is to support the housing 1 vertically, with the opening 5 up, and partially insert, within the liner 7, a funnel 15 having a pouring cone 17, a long tubular stem 19 and an intermediate annular flange 21. As shown in FIG. 3, the funnel 15 is inserted until the lower face of flange 21 engages the upper end 23 of the housing 3 and the lower end 25 of the funnel is flush with the lower end 27 of the liner 7. The annular space between the lower ends 25 and 27 is sealed liquid-tight by a sealing O-ring 29, e.g. of Neoprene rubber, carried by the stem 19 and slidable within the liner 7.

Figure 5:
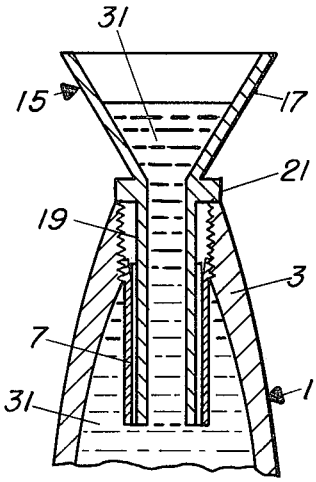
FIG. 5 is a view like FIG. 3 after the projectile has been filled with explosive material.

Molten explosive material is poured into the funnel 15 until the housing 3 and funnel are filled to a level above the upper end of the liner 7, and allowed to cool to a solid state, as shown at 31 in FIG. 5.

Figure 6:
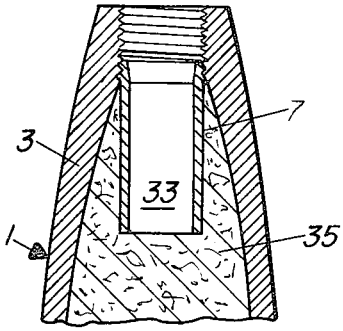
FIG. 6 is a view like FIG. 5 with the funnel removed.
Figure 7:
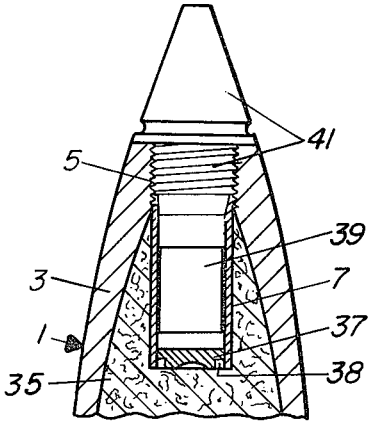
FIG. 7 is a view like FIG. 6 showing the completed projectile.

After the explosive material 31 has substantially solidified, the funnel 15 is carefully rotated slightly, to shear the explosive material at the lower end 25 without detonation, and then the funnel is removed with the riser of the material cast therein, leaving the desired cavity 33 in the main charge 35 lined with liner 7, as shown in FIG. 6.

Subsequently, a closure disc 37 may be secured in the lower end of the liner 7, and the projectile completed by assembling a supplementary charge 39 within the cavity 33 and screwing a suitable fuze 41 into he threaded opening 5. A groove 38 may be formed in the disc 37 to receive the seal ring 29, if the latter is left in the cavity.

It can be seen that the only hazardous operation involved in the present invention is the rotation of the funnel 51 to shear the explosive material 31 at the lower end 25, and this hazard can be minimized by performing this operation before the material 31 has completely solidified. The liner 7 is swaged to the threads in the opening 5 before explosive pour, which eliminates the possibility of a premature explosion during this operation. The necessity for inspecting the threads after the swaging operation for explosive fragments is eliminated. The concentricity of the cavity 33 in the housing 3 is determined by the positioning of the liner 7 in the opening 5, and hence, is independent of the funnel 15.

The foregoing disclosure and drawings are merely illustrative of the principles of this invention and are not to be interpreted in a limiting sense. We wish it to be understood that we do not desire to be limited to exact details of construction shown and described, because obvious modifications will occur to a person skilled in the art.

What is claimed is:

1. A method of making a high explosive projectile comprising a hollow metal housing containing a bursting charge having a metal liner embedded therein, comprising the steps of:

forming an axial bore in one end of said hollow projectile housing;

inserting an elongated open-ended tubular liner through said bore and rigidly securing the outer end of said liner to said projectile housing in said bore, with the liner extending axially into said housing;

supporting said projectile housing with its longitudinal axis vertical and said one end up;

inserting the tubular stem of a pouring funnel into said liner until the lower ends of said liner and funnel are flush with each other;

providing a liquid-tight seal between said lower ends;

pouring sufficient molten explosive material into said funnel to fill said projectile housing and said tubular stem to a level above said liner;

cooling said explosive material to a substantially solid cast state;

rotating said funnel relative to said liner and said housing to shear the cast material at said lower end of said funnel stem; and removing said funnel from said liner and projectile.

2. The method of claim 1, wherein said funnel comprises an external annular stop flange positioned to engage the upper end of said projectile housing when said lower ends are flush with each other.

3. The method of claim 1, further comprising the subsequent step of: inserting and securing a closure disc in the lower end of said liner.

4. The method of claim 1, wherein said bore is threaded to receive the external threaded portion of a fuze for initiating said bursting charge, and said outer end of said liner is secured in the inner end of said threaded bore by a swaging operation.

5. The method of claim 1, wherein said liquid-tight seal is provided by a resilient O-ring carried by said funnel stem and slidably engaging said liner.

* * * * *